US005732435A

United States Patent [19]

Williams et al.

[11] Patent Number: 5,732,435

[45] Date of Patent: Mar. 31, 1998

[54] PORTABLE CLEANING DEVICE FOR GOLF CLUBS

[75] Inventors: Christopher R. Williams, Grandville; Ronald A. Williams, Grand Rapids; Austin F. Noll, III, Rockford, all of Mich.

[73] Assignee: Danali Products, Inc., Grand Rapids, Mich.

[21] Appl. No.: 678,918

[22] Filed: Jul. 12, 1996

[51] Int. Cl.[6] ..... A63B 57/00; A46B 11/00

[52] U.S. Cl. ..... 15/104.92; 15/160

[58] Field of Search ..... 15/21.2, 104.92, 15/104.93, 160; 401/9, 10, 131; D9/337, 338; D21/234; D32/1, 35

[56] References Cited

U.S. PATENT DOCUMENTS

| | | | |
|---|---|---|---|
| 597,728 | 1/1898 | Mitchell | 15/104.92 |
| 3,224,029 | 12/1965 | Domingos | 15/104.92 |
| 3,365,739 | 1/1968 | Olinghouse | 15/21.2 |
| 3,583,018 | 6/1971 | Fink | 15/104.92 |
| 3,977,036 | 8/1976 | Vanyi | 15/104.92 |
| 4,069,536 | 1/1978 | Hartz et al. | 15/160 |
| 5,155,883 | 10/1992 | Legault | 15/21.2 |
| 5,533,225 | 7/1996 | Ellis | 15/160 |
| 5,664,277 | 9/1997 | Matlick | 15/104.92 |
| 5,666,684 | 9/1997 | Cussen | 15/104.93 |

*Primary Examiner*—Terrence Till

*Attorney, Agent, or Firm*—Rader, Fishman, Grauer & McGarry

[57] ABSTRACT

A device for cleaning golf-club heads comprises a receptacle for containing cleaning solution open at its upper end for receiving a golf-club head to be cleaned, and at least one brush mounted within the receptacle for engagement with the club head. An extension of a base portion projects outwardly of the device a sufficient distance to receive at least a portion of a user's foot thereon to stabilize the cleaning device when supported in an upright position on a horizontal surface. A handle may be formed on the base portion extension for conveniently lifting and transporting or for storing and draining the cleaning device. A cap may be provided for closing the upper end of the receptacle to prevent loss of cleaning liquid during transportation and handling of the cleaning device.

17 Claims, 4 Drawing Sheets

PORTABLE CLEANING DEVICE FOR GOLF CLUBS

BACKGROUND OF THE INVENTION

1. Field of the Invention

This invention relates to golfing accessories, and more particularly to a portable device for cleaning the heads of golf clubs.

2. Description of the Prior Art

During play, the head of a golf club, and particularly its face and sole, tend to accumulate soil, sand, grass, stains of various kinds, and sometimes, especially if the ball is poorly struck, streaks of the paint which coats the ball or tee. If allowed to remain, such extraneous matter renders the club unsightly at best and less effective at worst, as described hereinbelow. In some circles it is considered a breach of golf etiquette to begin a round with stained or dirty clubs.

The face of almost every modern golf iron, moreover, is formed with a series of parallel grooves oriented generally horizontally when the club is held in the address position. These grooves are intended to afford the golfer greater control over his shot by applying a backspin on the ball as it is struck by the iron and propelled through the air to its intended destination. The backspin tends to arrest the forward motion of the ball after it has landed. The faces of most golf woods are provided with grooves as well, though they may be shallower than those formed in irons. In any case, the grooves in the club head play a significant role in establishing the degree of accuracy with which the game may be played.

Though a golfer may carry as part of his equipment a towel or a hand-held brush for cleaning the club head after each shot, moist or dry earth, sand, grass, and other debris may become firmly lodged in the grooves and not readily displaced. In any case, when the grooves become filled and are allowed to remain filled, the golf ball will not acquire the desired backspin when struck, and may roll well beyond the spot targeted by the golfer.

Many golf-club cleaning expedients have heretofore been proposed to overcome the problem of dirty club heads. A number of them have in common the provision of a golf-club cleaning device formed with a receptacle for holding cleaning fluid and opposed brushes. An early example is disclosed in U.S. Pat. No. 2,744,276, issued May 8, 1956 to E. F. Chambless. The golf-club head is simply inserted into the receptacle and scrubbed between the brushes until clean.

Some of these prior club cleaning devices are intended to be placed at various locations on the golf course, where they may be staked to the ground or bolted to benches, upright standards, or other immovable objects, as disclosed variously in U.S. Pat. No. 4,069,536, issued Jan. 24, 1978 to R. E. Hartz et al.; U.S. Pat. No. 4,380,839, issued Apr. 26, 1983 to C. Caradonna; U.S. Pat. No. 4,821,358, issued Apr. 18, 1989 to C. R. Wyckoff et al.; and U.S. Pat. No. 5,081,735, issued Jan. 21, 1992 to W. B. Wyatt et al.

Other club cleaning devices are so constructed that they may be secured to the motorized golf carts now available at nearly all golf courses, public and private. Examples may be found in the aforesaid patents to Wyckoff et al. and Wyatt et al., as well as in U.S. Pat. No. 4,944,063, issued Jul. 31, 1990 to J. Jordan; and U.S. Pat. No. 4,965,906, issued Oct. 30, 1990 to E. Mauro.

A portable golf-club cleaning device; that is, a cleaning device that may be carried by an individual is disclosed in U.S. Pat. No. 5,404,610, issued Apr. 11, 1995 to D. F. Coyer, Sr. et al. This comprises a bucket-type receptacle provided with a cap which is apertured to permit golf-club heads to pass through it. Brushes and cleaning solution are disposed in the receptacle for scrubbing the club heads. However, the cleaning device of Coyer, Sr. et al. is inherently unstable when supported in an upright position on a horizontal surface, since the receptacle is inversely frusto-conical in form. Moreover, there is no provision for stabilizing the receptacle during either transportation or the procedure of cleaning the club heads.

The club cleaning device of the aforesaid patent to Caradonna is also said to be adaptable for use as "a portable, free standing model with its own cast iron stand." However, particulars of such a stand are neither described nor illustrated in Caradonna. In any case, because the vertical dimension of Caradonna's cleaning device is shown to be substantially greater than its horizontal dimension, it may be presumed that the stand must be a heavy and broad one indeed to impart stability during the cleaning procedure.

U.S. Pat. No. 4,734,952, issued Apr. 5, 1988 to J. J. Parchment et al. discloses a golf-club head cleaning device comprising a receptacle that may be mounted to a structure such as a golf cart by way of mechanical fasteners or "used simply by placing it on the ground, holding it securely between the golfer's feet" during cleaning.

Like those of the aforesaid patents to Coyer, Sr. et al. and Parchment et al., many prior art golf-club cleaning devices are provided with bucket-like receptacles that generally decrease in cross-sectional area from top to bottom. Not only are such configurations inherently unstable, but when water or other cleaning liquid is added, the center of gravity is elevated, resulting in even greater receptacle instability, especially when subjected to the vigorous scrubbing motion of the cleaning procedure. Other prior art golf-club cleaning devices, such as that of Caradonna, comprise receptacles that are cylindrical in configuration or are otherwise formed with a constant cross-sectional area from top to bottom, but these receptacles, too, may topple over easily unless they are securely fastened to a support structure or surface.

It will be recognized from the foregoing review of prior art that there has been a need, first of all, for a truly portable golf-club head cleaning device, one which is easily lifted and carried by a single golfer, so that it may be carried in the golfer's personal vehicle to the place of play, there to be used for cleaning his or her clubs when the round has been played, or which, alternatively, may be kept in the garage, basement or utility room of the golfer's home for use when he or she returns from playing a round of golf, or at any convenient time for that matter, and secondly, for such a portable golf-club head cleaning device which may be made securely stable when supported in an upright position on a horizontal surface, regardless of the vigor with which the golfer uses it to clean the club heads.

SUMMARY OF THE INVENTION

The present invention, on the other hand, provides a device for cleaning golf-club heads which not only comprises a receptacle open at its upper end thereof for receiving a golf-club head to be cleaned, and at least one brush mounted within the receptacle for engagement with the club head, the receptacle having a sidewall and a base portion, but is also provided with an extension of the base portion which projects outwardly of the device a sufficient distance to receive at least a portion of a user's foot thereon to stabilize the cleaning device when supported in an upright position on a horizontal surface.

Moreover, in a preferred embodiment a handle is formed on the base portion extension for conveniently lifting and transporting the cleaning device. The handle also serves as a convenient site for hanging the device for storage or complete draining of cleaning solution.

A cap may be provided for closing the upper end of the receptacle to prevent loss of cleaning liquid during transportation and handling of the cleaning device, the cap in a preferred embodiment being hingedly attached to the receptacle for pivotal movement between open and closed positions.

An anti-slip tread may be disposed on an upper surface of the extension to prevent slippage of a user's foot placed thereon. Similarly, an anti-slip surface may be provided at the bottom of the device to prevent it from slipping during use.

These and other features, advantages and objects of the invention will be apparent from the ensuing description taken in conjunction with the accompanying drawings.

DESCRIPTION OF THE PREFERRED EMBODIMENTS

Figure 1:
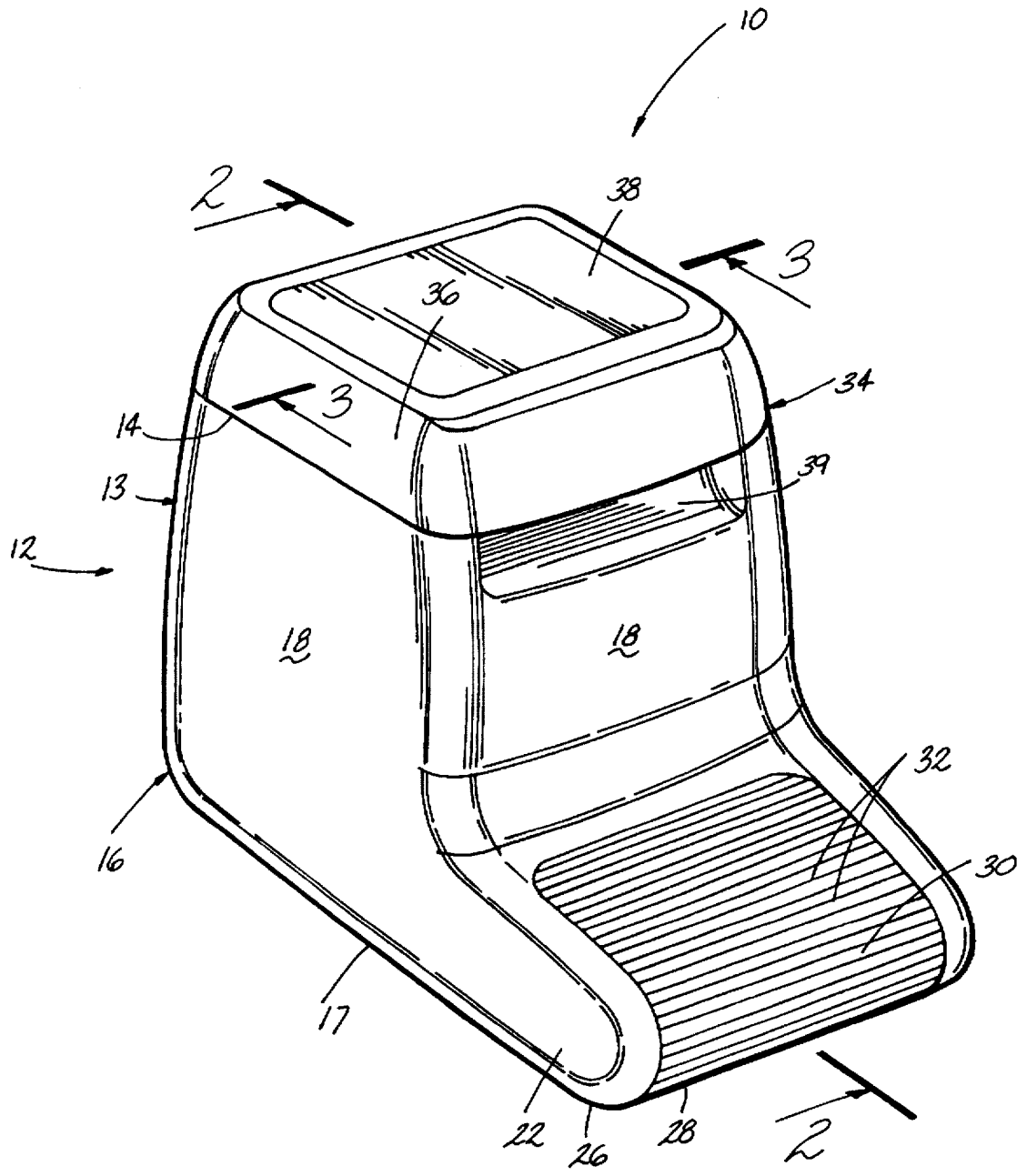
FIG. 1 is a perspective view of a golf-club head cleaning device according to the invention.
Figure 2:
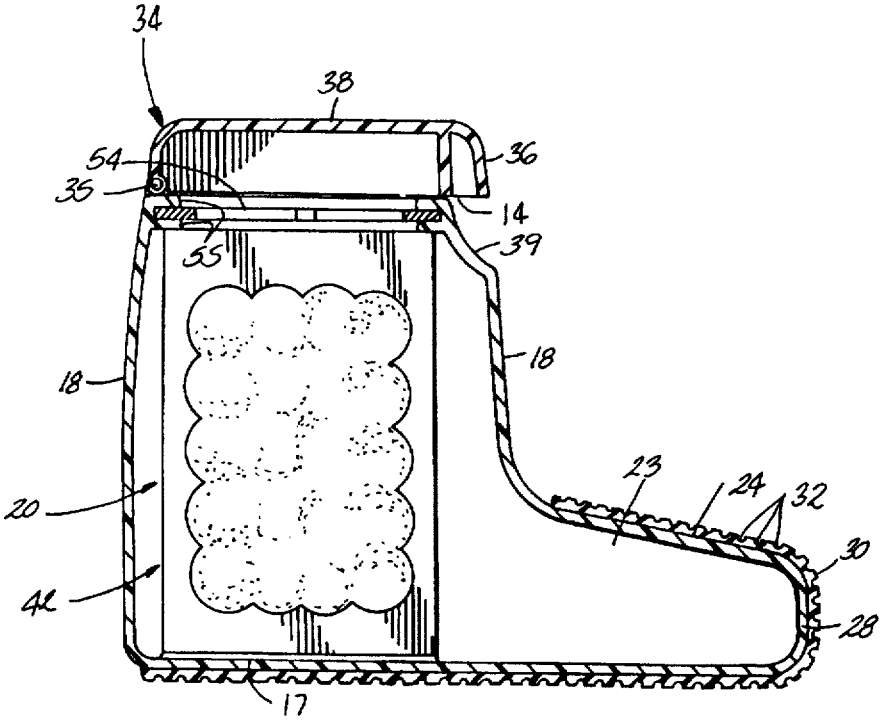
FIG. 2 is a cross-sectional view of the golf-club head cleaning device of FIG. 1, taken along line 2—2 thereof.
Figure 3:
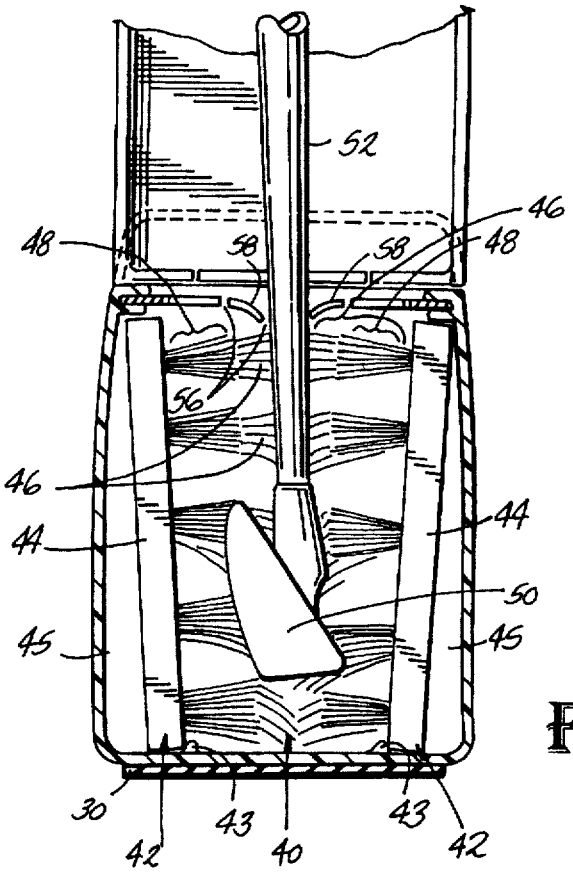
FIG. 3 is a cross-sectional view of the golf-club head cleaning device of FIGS. 1 and 2, taken along line 3—3 of FIG. 1.

Referring to FIGS. 1 to 3, a golf-club head cleaning device 10 comprises principally a container or receptacle 12. An upper portion 13 of receptacle 12 is formed with an upper surface 14, while a base portion 16 includes a bottom surface 17. A sidewall 18 comprising four panels extends between upper surface 14 and bottom surface 16. Sidewall 18 defines with the upper and bottom surfaces a chamber 20 open at its upper end to receive and contain a cleaning liquid therein (not shown), such as water, soap dissolved in water, or any other suitable solvent or cleaning solution.

Figure 4:
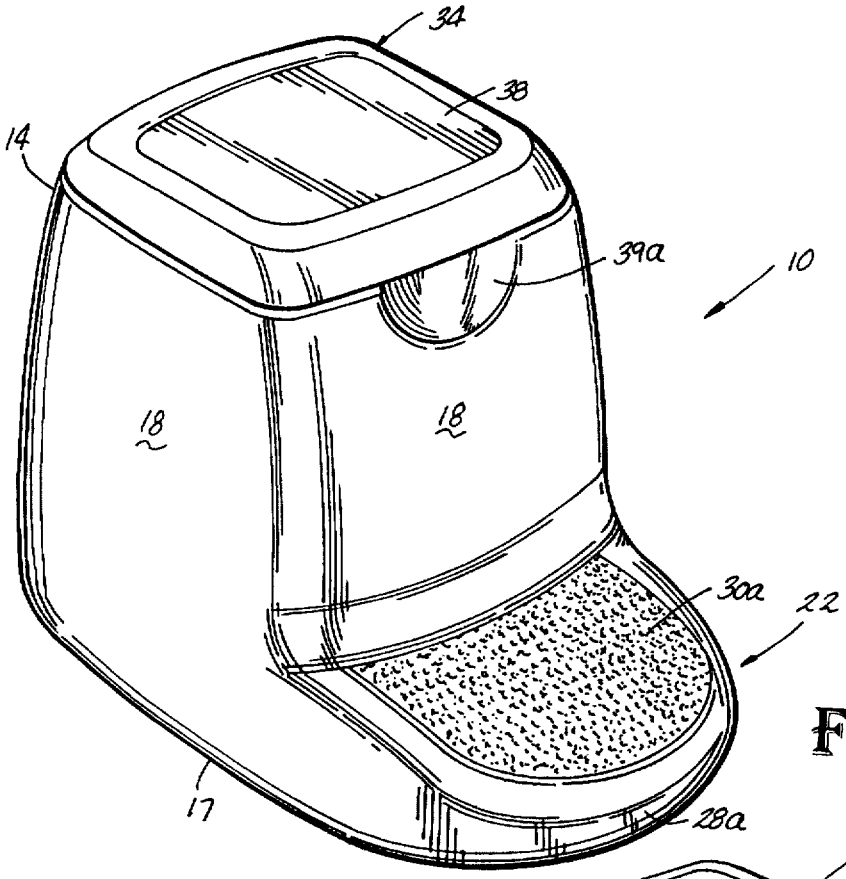
FIG. 4 is a perspective view of a second embodiment of the golf-club head cleaning device according to the invention.
Figure 5:
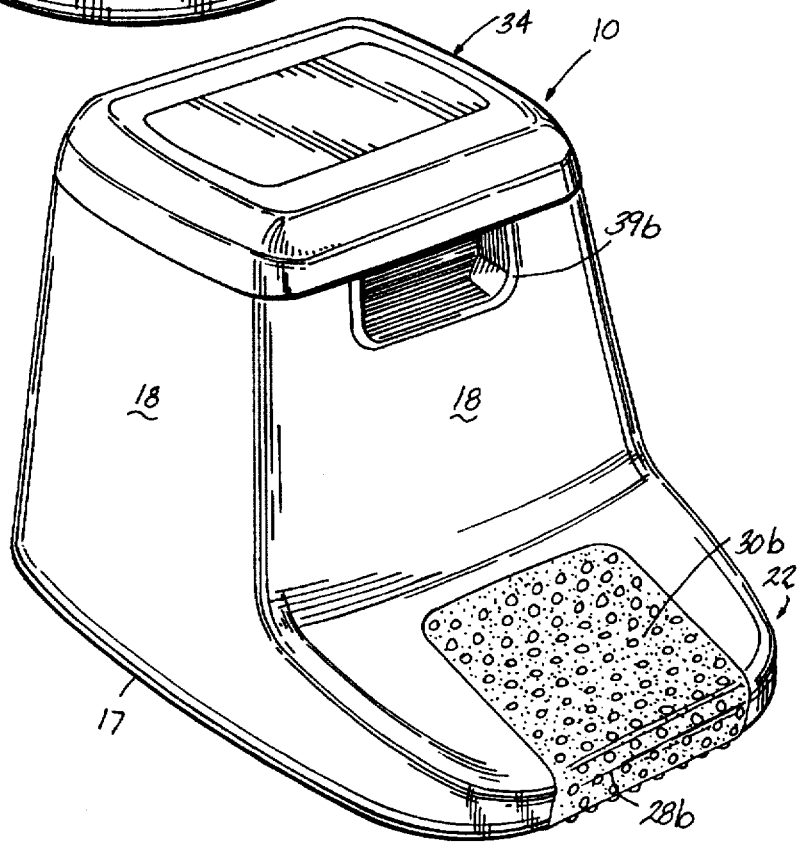
FIG. 5 is a perspective view of a third embodiment of the golf-club head cleaning device according to the invention.

As illustrated in FIGS. 1 and 4, the sidewall panels may be concave outwardly. Alternatively, they may be substantially planar, as shown in FIG. 5, which also shows them to be inclined inwardly. An extension 22 of the base portion extends outwardly from a front one of the sidewall panels and includes upper and lower surfaces 24, 26 interconnected by a front wall 28. Lower surface 26 is preferably an extension of and continuous with bottom surface 17. Extension 22 extends outwardly a sufficient distance to permit at least a portion of a user's foot to be placed thereon for stabilizing the receptacle during club head cleaning.

Front wall 28 of extension 22 may take any one of a number of configurations. For example, it may be substantially planar as shown in FIGS. 1 and 2, or it may be convex outwardly as shown at **28*a* in FIG. 4, or it may be planar but curved at both ends to merge smoothly into sidewall 18 as shown at 28*b*** in FIG. 5.

The intersection of sidewall 18 and lower surface 17 defines a base periphery and the intersection of sidewall 18 and upper surface 14 defines an upper periphery. Preferably, the base periphery encloses an area greater than that enclosed by the upper periphery, thereby to enhance the stability of the club cleaning device when supported in an upright position on a horizontal surface. Stability is even further enhanced by the fact that the base periphery also includes the intersection of front wall 28 with bottom surface 26 of extension 22 and the intersection of the lateral ones of sidewalls 18 with bottom surface 26, thereby enclosing a much greater area than that enclosed by the upper periphery.

Upper surface 24, bottom surface 26, front wall 28, and sidewall 18 form an interior hollow portion which comprises an extension 23 of chamber 20. Chamber extension 23 may be lined with supporting ribs (not shown) for resisting pressure from a user's foot when placed on upper surface 24. Receptacle 12 is preferably formed by blow molding, injection molding or rotary casting to form a continuous fluid-tight chamber 20. When cleaning liquid is added to chamber 20 it will, of course, be received in chamber extension 23 as well, thus resulting in a lower center of gravity for the liquid than would have been realized for the same volume of liquid if chamber extension 23 had not been provided, whereby the stability of the cleaning device is enhanced still further.

An anti-slip tread 30 is attached to upper surface 24 of extension 22 and preferably wrapped around front wall 28 to extend to bottom surfaces 26 and 17. The provision of a single anti-slip tread in this manner serves the dual purpose of resisting slippage between a user's foot and the receptacle and slippage between the receptacle and the supporting surface.

Alternatively, an anti-slip tread **30*a* may be integrally formed on the upper extension surface 24 as shown in FIG. 4, during molding for example, or it may be mechanically or chemically attached by well-known techniques after molding. Such an integral tread may extend continuously by way of front wall 28 to bottom surface 17 or it may be provided separately on upper surface 24 and bottom surfaces 26, 17**.

As shown in FIG. 1, anti-slip tread 30 includes a plurality of spaced parallel ribs 32. The ribs preferably extend throughout the length of the tread as a continuous tread pattern. Alternatively, the tread may have a variety of patterns extending throughout its length, depending on the different natures of the surfaces to be engaged with the tread. For example, a length of the tread associated with upper surface 24 may include ribs especially adapted for securely engaging the sole of a golf shoe, while a second length of the tread associated with bottom surface 26 may include spikes, suction cups, or other protrusions for secure engagement with soft ground, hard surfaces, etc. Anti-slip tread 30, **30*a* may extend over a substantial portion of the upper surface as shown in FIGS. 1 and 4. As a further alternative, a tread 30*b*** formed either separately or integrally with the upper surface may extend over only a portion thereof as shown in FIG. 5.

A cap 34 is adapted to mate with upper surface 14 of receptacle 12 to sealingly close chamber 20. The cap includes side panels 36 thereof that are formed to be flush with the panels of sidewall 18 when the cap is mounted on the receptacle. A cap upper panel 38 is formed integrally with side panels 36 and is preferably devoid of any apertures in order to sealingly enclose chamber 20. A hinge 35 retains cap 34 on receptacle 12 and permits the cap to be rotated between open and closed positions in use.

Alternatively, cap 34 may include depending flanges (not shown) for frictionally engaging sidewalls 18 in a fluid-tight fit. In any event, cap 34 is preferably injection molded. Upper panel 38 may, if so desired, be made strong enough to support a user's weight when sitting or standing thereon, in order to permit the cleaning device to be used as a seat or stepping platform.

A recess 39 extends from receptacle upper surface 14 into one of sidewalls 18 for facilitating the removal of cap 34. Although only one recess 39 is shown, a second recess on an opposing sidewall may be provided for lifting the cap evenly when the cap is friction fit within the opening. FIGS. 4 and 5 show alternative recesses 39*a*, 39*b* which extend across only a portion of wall 18 and may be circular in shape as shown at 39*a*, or rectangular as shown at 39*b*. A latch may be associated with receptacle 12 and cap 34 to lock the cap against opening when the cleaning device is not in use for cleaning golf-club heads.

As shown in FIG. 3, chamber 20 is fitted with a brush assembly 40, which preferably includes a pair of opposed brushes 42 mounted within chamber 20. More particularly, each brush 42 includes a backing member 44 anchored between a stop 43 and a flange 45 of one of sidewalls 18. Opposing flanges 45 orient the brushes at an acute angle with respect to each other for permitting a wide range of golf-club heads to be inserted therebetween for cleaning. Alternatively, backing member 44 of each brush may be formed with a configuration suitable for disposing the brushes in a similar manner without the use of flanges 45.

A plurality of long bristles 46 and short bristles 48 are generally uniformly disposed along the inwardly facing surface of backing members 44. With this arrangement, the bristles from the oppositely facing brushes 42 are positioned to scrub mud, dirt, grass, and other debris from a head 50 of an iron-type golf club 52 inserted therebetween, and yet are not so closely proximate or rigid as to prevent the larger wood-type golf-club heads from being received therebetween for cleaning.

A shield or gasket 54 is positioned in receptacle 12 above brushes 42 and below cap 34 in contact with the inside surfaces of sidewalls 18. A pair of inwardly projecting flanges 55 extend around the receptacle periphery to sandwich gasket 54 therebetween, where it is held by frictional fit, adhesives, or other well-known means of attachment. The gasket may be formed of any suitable flexible material, and includes a plurality of interconnected slits 56 which form a plurality of movable gasket flaps 58. The gasket flaps are arranged to permit a golf-club head to pass through the gasket while acting to prevent cleaning solution within the receptacle from splashing or spraying outwardly of the receptacle during golf-club head cleaning.

The cleaning device of the invention may be assembled by first inserting brushes 42 into receptacle 12 and positioning them against stops 43 and flanges 45 so that bristles 46 and 48 face each other at an angle. Gasket 54 is then positioned between flanges 55. A cleaning fluid is subsequently poured into the receptacle to at least partially fill chamber 20 and chamber extension 23. Cap 34 is then closed to prevent loss of fluid during transport or handling of the device.

In operation, a user first places the receptacle on a horizontal surface in its upright position and opens it by grasping the side panel 36 of cap 34 adjacent to recess 39 and rotating the cap about hinge 35. Before or after rotating the cap to its open position, the user places one foot on upper surface 24 of extension 22 to securely stabilize the receptacle in the upright position. A golf-club head is then inserted through slits 56 in gasket 54 and vigorously moved up and down within the interior of the chamber between the brushes to dislodge the mud, dirt, grass or other debris appended to the golf-club head surfaces.

Figure 6:
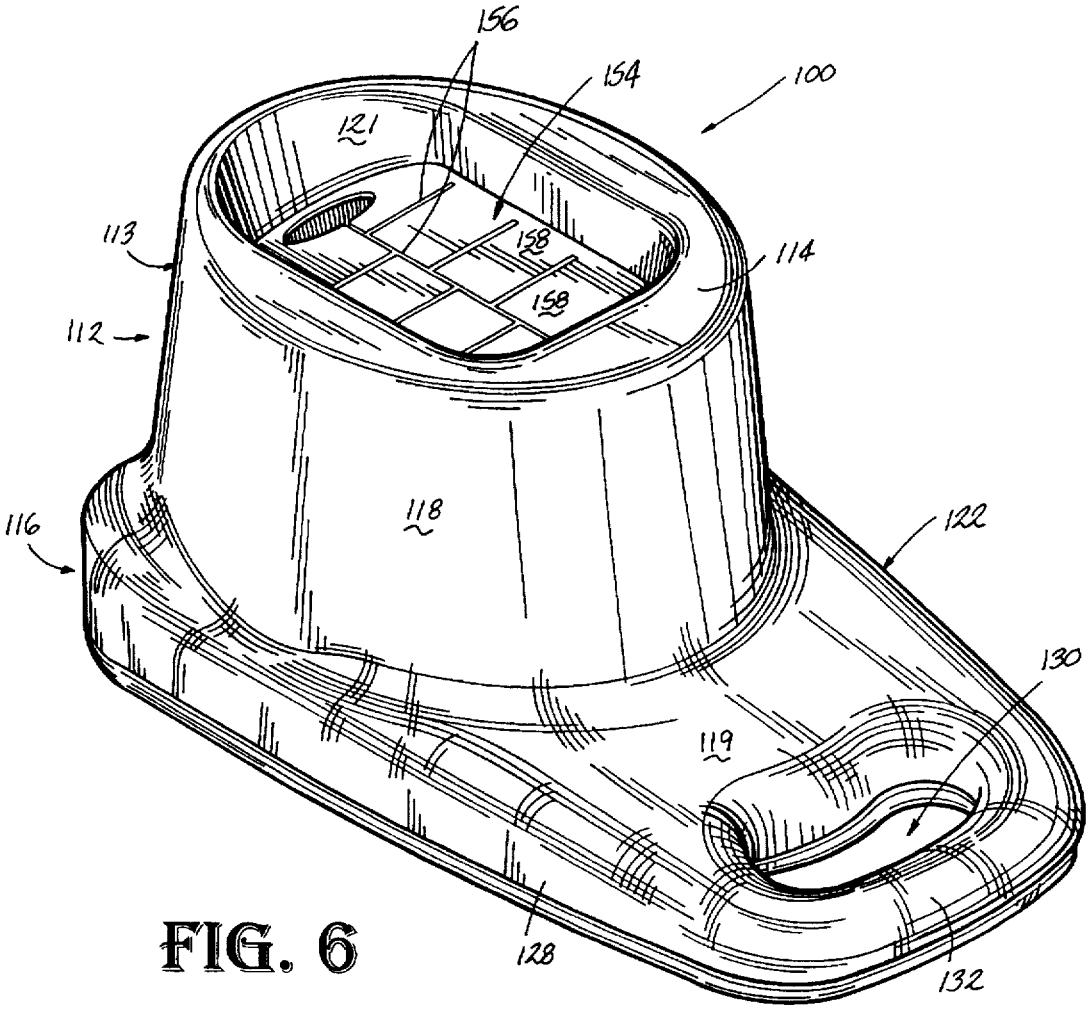
FIG. 6 is a perspective view of a fourth embodiment of the golf-club head cleaning device according to the invention.
Figure 7:
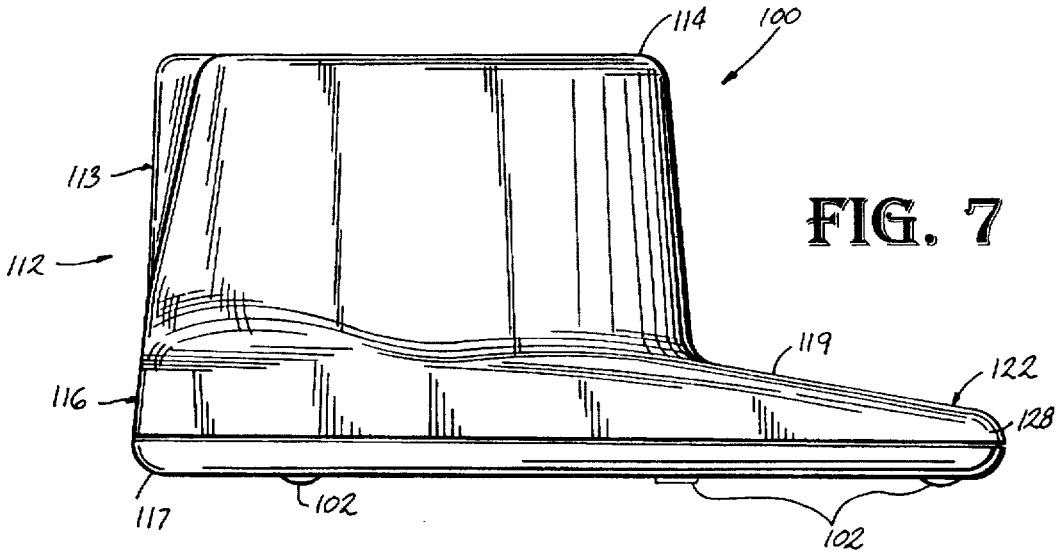
FIG. 7 is a side elevational view of the golf-club head cleaning device of FIG. 6.

Turning now to FIGS. 6 and 7, a golf-club head cleaning device 100 includes a receptacle 112 having an upper portion 113 and a base portion 116. Upper portion 113 includes a generally horizontally extending upper surface 114, while base portion 116 includes an upper surface 119 and a bottom surface 117. A plurality of rubber feet 102 depend from bottom surface 117 to prevent slippage of the cleaning device during transportation or use. A continuously curved outer sidewall 118 is integral with and extends between upper surface 119 of base portion 116 and upper surface 114 of upper portion 113. An inner sidewall 121 is integral with and extends between upper surface 114 and a lower surface (not shown) to define an open chamber 120 for holding fluid therein, such as cleaning fluid (not shown).

The upper surface 119 and bottom surface 117 of base portion 116 are integrally connected with a lower sidewall 128 that extends around the periphery of the base portion. An extension 122 forms part of the base portion 116 and projects outwardly from sidewall 118 and includes upper surface 119, lower surface 117, and lower sidewall 128. Extension 122 projects outwardly a sufficient distance to permit at least a portion of a user's foot to be placed thereon for stabilizing the receptacle during club head cleaning.

An opening or aperture 130 has a width sufficient to receive the hand of a user and extends through extension 122 of the base portion to define with the distal end thereof a carrying handle 132 that can be grasped by a user to facilitate transporting cleaning device 100. The aperture may also receive a hook, a peg or the like (not shown) to hang the device for storage or complete draining of the cleaning solution. Lower sidewall 128 defines a base periphery and the intersection of sidewall 118 and upper surface 114 defines an upper periphery. Here, too, the base periphery preferably encloses an area greater than the area enclosed by the upper periphery to impart a large measure of stability to the cleaning device. As in the embodiments of FIGS. 1 to 4, a chamber extension formed by a hollow interior portion (not shown) of extension 122 may be lined with supporting ribs (also not shown) for resisting pressure from a user's foot when placed on upper surface 119. Receptacle 112 is also preferably formed by blow molding, injection molding or rotary casting to form a continuous fluid-tight chamber.

A gasket 154 similar to gasket 54 is positioned in receptacle 112 above a pair of brushes (not shown) disposed in the chamber and is in contact with inner sidewall 121. This gasket, too, may be attached to inner sidewall 121 through frictional fit, adhesives, or other well known means of attachment. The gasket includes a plurality of interconnected slits 156 which form a plurality of movable gasket flaps 158 for receiving a golf-club head while acting to prevent cleaning solution within the receptacle from splashing or spraying out during golf-club head cleaning.

It will be recognized that any number of ancillary features may be provided in or on the cleaning device of the invention. Referring to FIGS. 6 and 7, for example, a socket (not shown) might extend downwardly from upper surface 114 adjacent to the chamber formed by receptacle 112 to contain an elongated handled brush (not shown) with the bristles of the latter lowermost and in contact with cleaning solution (when provided) contained in the chamber. Such a brush might be tethered to the cleaning device to prevent inadvertent loss.

A towel (not shown) might also be removably fastened to the cleaning device by any suitable means. For example, it might be carried by any one of several well-known fastening rings (not shown) attached to a rod (also not shown) mounted on the receptacle in an upright position. Such a rod might be of telescoping construction for adjustment of the towel to a convenient height above the receptacle during the cleaning process.

While the invention has been described in connection with certain specific embodiments thereof, it will be understood that this is by way of illustration and not of limitation, and that the scope of the appended claims should be construed as broadly as the prior art will permit.

What is claimed is:

1. In a device for cleaning golf-club heads, comprising:

a receptacle having a base portion and an upper portion;

sidewall means extending from the base portion and terminating at the upper portion to define a chamber open at its upper end and extending from the upper portion to the base portion; and at least one brush located within the chamber for cleaning the head of a golf club;

the intersection of the sidewall means and the base portion defining a base periphery and the intersection of the sidewall means and the upper portion defining an upper periphery;

the sidewall means, the base portion, and the upper portion being so dimensioned that the base periphery encloses an area greater than the area enclosed by the upper periphery;

the improvement comprising an extension forming part of the base portion and projecting outwardly from the sidewall means a sufficient amount to permit at least a portion of a user's foot to be placed thereon to stabilize the cleaning device in an upright position when supported on a horizontal surface.

2. In a cleaning device according to claim 1, the further improvement wherein the chamber is adapted to receive cleaning fluid, the extension forming a hollow interior portion in communication with the chamber, whereby the weight of cleaning fluid received in the chamber acts to further stabilize the cleaning device.

3. In a cleaning device according to claim 1, the further improvement wherein the extension includes an upper surface, and an anti-slip tread extending therealong.

4. In a cleaning device according to claim 3, the further improvement wherein the anti-slip tread is formed integrally with the upper surface of the extension.

5. In a cleaning device according to claim 3, the further improvement wherein the anti-slip tread is formed separately from the extension and is attached to the upper surface thereof.

6. In a cleaning device according to claim 1, the further improvement wherein the extension includes an upper surface and the base portion includes a lower surface; and the cleaning device comprises an anti-slip tread extending from the upper surface of the extension to the lower surface of the base portion.

7. In a cleaning device according to claim 6, the further improvement wherein the anti-slip tread is formed integrally with the upper surface of the extension and the lower surface of the base portion.

8. In a cleaning device according to claim 6, the further improvement wherein the anti-slip tread is formed separately from the extension and is attached to the upper surface thereof.

9. In a cleaning device according to claim 1, the further improvement comprising a cap adapted to abut the upper portion for closing the chamber.

10. In a cleaning device according to claim 9, the further improvement wherein the cap has an upper surface devoid of openings to seal the chamber against leakage during transportation and handling of the cleaning device.

11. In a cleaning device according to claim 10, the further improvement comprising a gasket positioned in the chamber and accessible when the cap is removed, the gasket having at least one opening for receiving a golf-club head in the chamber.

12. A device for cleaning golf-club heads, comprising a receptacle open at an upper end thereof for receiving a golf-club head to be cleaned, at least one brush mounted within the receptacle for engagement with a golf-club head, the receptacle having a sidewall and a base portion thereof, an extension of the base portion projecting outwardly of the device to define means for receiving at least a portion of a user's foot thereon to stabilize the cleaning device when supported in an upright position on a horizontal surface.

13. A cleaning device according to claim 12, including a handle formed on the base portion extension for lifting and transporting the cleaning device and for hanging the device for storage or complete drainage of cleaning solution from the receptacle.

14. A cleaning device according to claim 13, including an aperture in the base portion extension, the aperture having a width sufficient to receive the hand of a user.

15. A cleaning device according to claim 14, wherein the aperture and a distal end of the base portion extension cooperate to define the handle.

16. A cleaning device according to claim 12, including a cap for closing the upper end of the receptacle.

17. A cleaning device according to claim 16, wherein the cap is hingedly attached to the receptacle for pivotal movement between open and closed positions of the cap.

* * * * *

UNITED STATES PATENT AND TRADEMARK OFFICE

CERTIFICATE OF CORRECTION

PATENT NO.: 5,732,435

DATED: March 31, 1998

INVENTOR(S): CHRISTOPHER R. WILLIAMS ET AL.

It is certified that error appears in the above-identified patent and that said Letters Patent is hereby corrected as shown below:

On the title page: Item [73] Assignee
"Danali" should be --Denali--.

Column 7, claim 1, line 23:
"its" should be --an--.

Column 7, claim 1, line 23:
after "end" insert --thereof--.

Signed and Sealed this

Twenty-first Day of July, 1998

Bruce Lehman

*Attest:*

BRUCE LEHMAN

*Attesting Officer*

*Commissioner of Patents and Trademarks*